US006189178B1

(12) United States Patent
Roberts

(10) Patent No.: US 6,189,178 B1
(45) Date of Patent: Feb. 20, 2001

(54) HANDHELD EXTRACTION CLEANER

(75) Inventor: Kenneth L. Roberts, Rockford, MI (US)

(73) Assignee: Bissell Homecare, Inc., Grand Rapids, MI (US)

( * ) Notice: Under 35 U.S.C. 154(b), the term of this patent shall be extended for 0 days.

(21) Appl. No.: 09/520,270

(22) Filed: Mar. 7, 2000

Related U.S. Application Data

(62) Division of application No. 09/206,023, filed on Feb. 4, 1998.

(60) Provisional application No. 60/067,558, filed on Dec. 5, 1997.

(51) Int. Cl.[7] ..... A47L 5/24; A47L 9/00

(52) U.S. Cl. ..... 15/323; 15/344; 15/DIG. 1

(58) Field of Search ..... 15/323, 344, DIG. 1

(56) References Cited

U.S. PATENT DOCUMENTS

| | | | | |
|---|---|---|---|---|
| 4,225,814 | | 9/1980 | Gantz et al. . | |
| 4,591,777 | * | 5/1986 | McCarty et al. | 15/DIG. 1 |
| 4,670,701 | | 6/1987 | Sako et al. . | |
| 4,899,418 | | 2/1990 | Steiner et al. . | |
| 4,920,608 | | 5/1990 | Hult et al. . | |
| 4,934,020 | | 6/1990 | Jackson . | |
| 5,005,252 | | 4/1991 | Steiner et al. . | |
| 5,025,529 | | 6/1991 | Hult et al. . | |
| 5,035,024 | | 7/1991 | Steiner et al. . | |
| 5,513,416 | * | 5/1996 | Bassler et al. | 15/323 |
| 5,604,953 | | 2/1997 | Castwall et al. . | |

* cited by examiner

*Primary Examiner*—Chris K. Moore
(74) *Attorney, Agent, or Firm*—Rader, Fishman, Grauer & Mc Garry

(57) ABSTRACT

A handheld liquid extraction cleaner according to the invention comprises a cleaner housing including a forward end, a rearward end, and a top portion and a bottom portion extending between the forward and rearward ends, and a handle for manually manipulating the extraction cleaner. A handheld cleaner and storage base according to the invention include a handheld cleaner comprising a cleaner housing including a forward end, a rearward end, a top portion and a bottom portion extending between the forward and rearward ends, sides extending between the top and bottom portions, and a handle for manually manipulating the extraction cleaner; and a storage base including a base portion and a holding portion disposed generally at a right angle to one another. A first inter-engaging retainer is disposed between the holding portion of the base and the bottom portion of the cleaner housing for removably supporting the handheld cleaner on the storage base and a second inter-engaging retainer is disposed between the base portion of the base and the rearward end of the cleaner housing for removably supporting the handheld cleaner on the storage base. A recess is formed in the holding portion of the base and adjacent to the bottom portion of the cleaner housing, and an accessory tool is releasably stored in the recess.

5 Claims, 14 Drawing Sheets

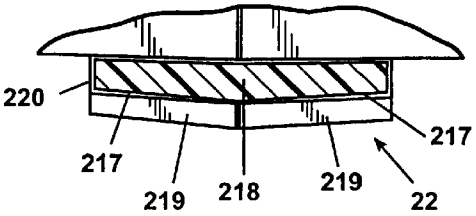
Fig. 2A
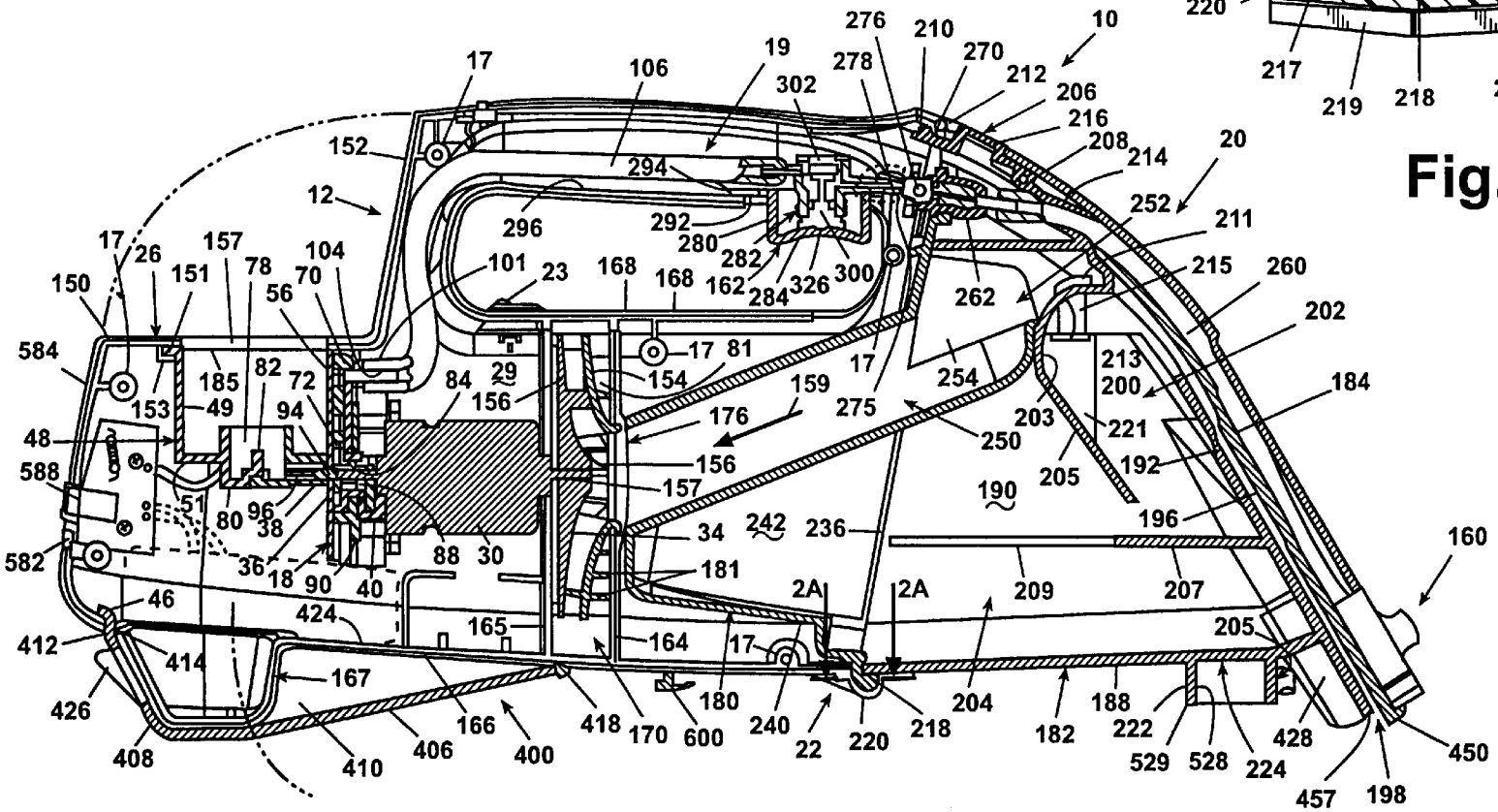
160
450
198
457
428
224
528
529
222
188
182
205
207
196
192
221
213
200
184
202
260
215
211
20
252
214
208
216
206
212
270
210
276
278
10
302
19
106
17
152
12
104
70
56
72
94
82
78
157
185
49
151
26
153
150
584
48
588
582
412
426
408
414
46
51
80
96
38
36
18
90
424
40
88
30
165
166
406
410
167
400
418
170
164
600
180
181
34
242
2A
240
22
220
218
236
2A
204
209
190
250
254
262
203
205
275
159
176
156
157
154
81
168
168
162
280
282
284
326
300
292
294
296
23
101
29
156
84
17
17
17

HANDHELD EXTRACTION CLEANER

STATEMENT OF PRIORITY

This application is a divisional application of U.S. patent application Ser. No. 09/206,023, filed Dec. 4, 1998, which claims the benefit of U.S. Provisional Application No. 60/067,558, filed on Dec. 5, 1997.

BACKGROUND OF THE INVENTION

1. Field of the Invention

This invention relates generally to extraction cleaners and more particularly to a portable, handheld extraction cleaner which applies cleaning fluid to a surface and then extracts the applied fluid therefrom.

2. Description of the Related Art

Portable, handheld extraction cleaners having a cleaning solution supply tank and a recovery tank are known. These extraction cleaners typically have a vacuum motor that powers an impeller to create low pressure on one side of the impeller and higher pressure on the other side thereof. The recovery tank is typically positioned between the low pressure side of the impeller and a fluid collection nozzle to remove fluid from a surface and deposit it in the recovery tank. It is also known to provide a separate cleaning fluid pump for directing cleaning fluid from the supply tank to the surface.

One handheld extraction cleaning device is disclosed in U.S. Pat. No. 4,788,738 issued to Monson et al. on Dec. 6, 1988. In this arrangement, a handheld extraction cleaner has a handle section removably joined to a lower discharge section. A collection chamber receives fluid from a surface through a nozzle opening that communicates with the intake side of a vacuum motor. The collection tank houses a hollow plenum chamber and a centrifugal separator attached to a vacuum blower. A cleaning fluid tank is pressurized by exhaust air from the outlet side of the rotating vacuum blower to force cleaning fluid under pressure from the cleaning fluid tank to a supply nozzle when a solution supply trigger is depressed to thereby apply cleaning fluid to a surface.

U.S. Pat. No. 5,367,740 issued to McCray on Nov. 29, 1994 discloses a handheld extraction cleaner that includes a housing, a handle, a body portion, and a nozzle with a suction opening. A collection tank is removably supported on the housing and is fluidly connected through a separator to a vacuum pump. The vacuum pump has an exhaust port and is powered by an electric pump motor. A solution tank is removably connected to the housing and is pressurized by a pressure pump that is also connected to the pump motor. A separate drive motor is coupled to a rotatable brush for scrubbing a surface to be cleaned.

SUMMARY OF THE INVENTION

According to the invention, includes a cleaner housing having a forward end, a rearward end, a top portion, and a bottom portion extending between the forward and rearward ends, and a handle for manually manipulating the extraction cleaner. It also includes a liquid extracting system having a recovery tank mounted to the forward end of the cleaner housing. The recovery tank includes a tank housing having a front face and an inlet opening at an upper portion of the tank housing. A suction conduit having a suction nozzle opening at a lower end of the front face of the tank housing is connected to the inlet opening at an upper end. The suction source is connected to the recovery tank for drawing liquid and debris through the suction nozzle and the suction conduit and into the recovery tank. The handheld extraction cleaner further includes a liquid dispensing system comprising a cleaning fluid supply tank, a spray nozzle mounted to the tank housing, a supply conduit interconnecting the cleaning fluid supply tank, and the spray nozzle, and a pump in the supply conduit for supplying pressurized cleaning fluid from the cleaning fluid supply tank to the spray nozzle. The spray nozzle is mounted to the front face of the tank housing. The spray outlet provides a cleaning solution spray pattern when the collar is in a first position, and the collar focuses the spray pattern in the second position. Preferably, the cleaning solution spray pattern is a flat fan shape.

In one embodiment, the spray nozzle is adjustable, and preferably includes a nozzle having a spray outlet and a collar mounted on the nozzle for axial movement between a first and second position relative to the spray outlet. The spray outlet provides a cleaning solution spray pattern when the collar is in the first position, and the collar focuses the spray pattern in the second position. Preferably, the cleaning solution spray pattern is a flat fan pattern. In another embodiment a suction conduit is formed by a suction channel in the front face of the tank housing and a cover is mounted over the suction channel.

A receptacle is formed in the cleaner housing and is adapted to matingly receive the cleaning fluid supply tank. Further, the cleaning fluid supply tank can include an opening in which a valve assembly is mounted to control the flow of cleaning fluid through the opening so that cleaning fluid flows through the opening when the cleaning fluid supply tank is seated in the receptacle and the flow of cleaning fluid through the opening is blocked when the cleaning fluid supply tank is unseated from the receptacle.

An accessory tool is releasably retained to at least one of the cleaner housing and the recovery tank housing. The accessory tool can include any one or more of a scoop, a squeegee, a crevice tool, and a brush. Where the accessory tool is the brush, a brush holder for releasably retaining the brush is formed in the bottom wall of the tank housing. Where the accessory tool is the scoop, the scoop is pivotally mounted to at least one of the cleaner housing and the recovery tank housing at one side and at a second side is retained on the cleaner housing or the recovery tank housing through a latch. In another embodiment of the invention, the lower end of the front face of the tank housing includes a lip adjacent to the suction nozzle opening. The squeegee and the crevice tool include a mounting tab for gripping the tank housing lip for mounting the squeegee and the crevice tool to the tank housing adjacent to the suction nozzle opening.

In another embodiment of the invention the handheld liquid extraction cleaner includes the supply conduit interconnecting the cleaning fluid supply tank to the spray nozzle for supplying cleaning fluid to the spray nozzle comprises a tube formed integrally with the recovery tank housing. Preferably, the tube is inside the recovery tank. In one version of this embodiment, the tube has an inlet opening in the recovery tank at the upper portion thereof, whereby the liquid and debris in the recovery tank is normally below the inlet opening when the extraction cleaner is in position for cleaning a horizontal surface and also when the extraction cleaner is in position for cleaning a vertical surface.

In a further embodiment of the invention, the recovery tank is mounted to the cleaner housing at one side through a pivot mounting and at a second side through a latch. Preferably, the latch is pivotally mounted to the upper portion of the tank housing and includes a retaining finger releasably engaging a flange on the forward end of the cleaner housing. In a preferred embodiment of the invention, a removable drain cap is removably mounted in an opening formed in a wall of the tank housing.

In a further embodiment of the invention, the a handheld liquid extraction cleaner has a storage base comprises a base which portion and a holding portion disposed generally at a right angle to one another and also includes first and second inter-engaging retainers. The first retainer is disposed between the holding portion of the base and the bottom portion of the cleaner housing for removably supporting the handheld cleaner on the base. The second retainer is disposed between the base portion of the base and the rearward end of the cleaner housing for removably supporting the handheld cleaner on the base. A recess is formed in the holding portion of the base and adjacent the bottom portion of the cleaner housing. An accessory tool is releasably stored in the recess.

Preferably, the recess is formed between the sidewalls of the cleaner housing. In one version, the recess faces away from the bottom surface of the cleaner housing and includes a crevice tool mounted therein. In another version, the recess faces toward the bottom surface of the cleaner housing and includes a brush mounted therein. The storage base preferably includes electrical contacts on the second retainer and electrical contacts on the rearward end of the cleaner housing, whereby the electrical contacts of each portion are in register with one another when the handheld cleaner is mounted on the storage base. The handheld cleaner of this embodiment includes a battery and a charging circuit connected to the battery and the electrical contacts on the rearward end of the cleaner housing, whereby the battery is recharged when the cleaner is mounted on the storage base.

BRIEF DESCRIPTION OF THE DRAWINGS

The invention will now be described with reference to the drawings in which:

FIG. 2 is a cross sectional view of the handheld extraction cleaner of FIG. 1 with some of the parts removed for clarity;

FIG. 2A is a cross sectional view of a lower portion of the recovery tank assembly of the handheld extraction cleaner of FIG. 1;

DETAILED DESCRIPTION OF THE PREFERRED EMBODIMENTS

Figure 1:
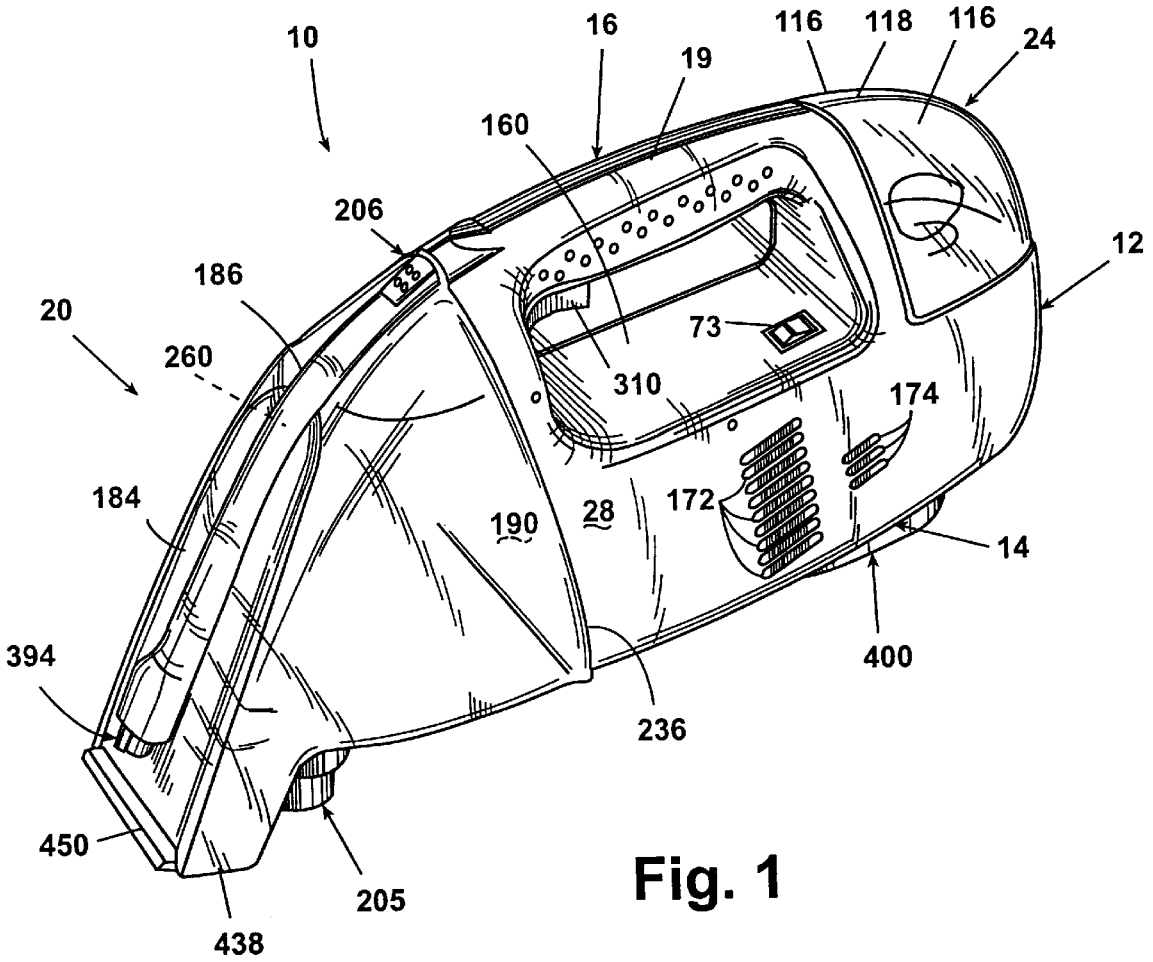
FIG. 1 is a perspective view of a portable, handheld extraction cleaner according to the invention.
Figure 1A:
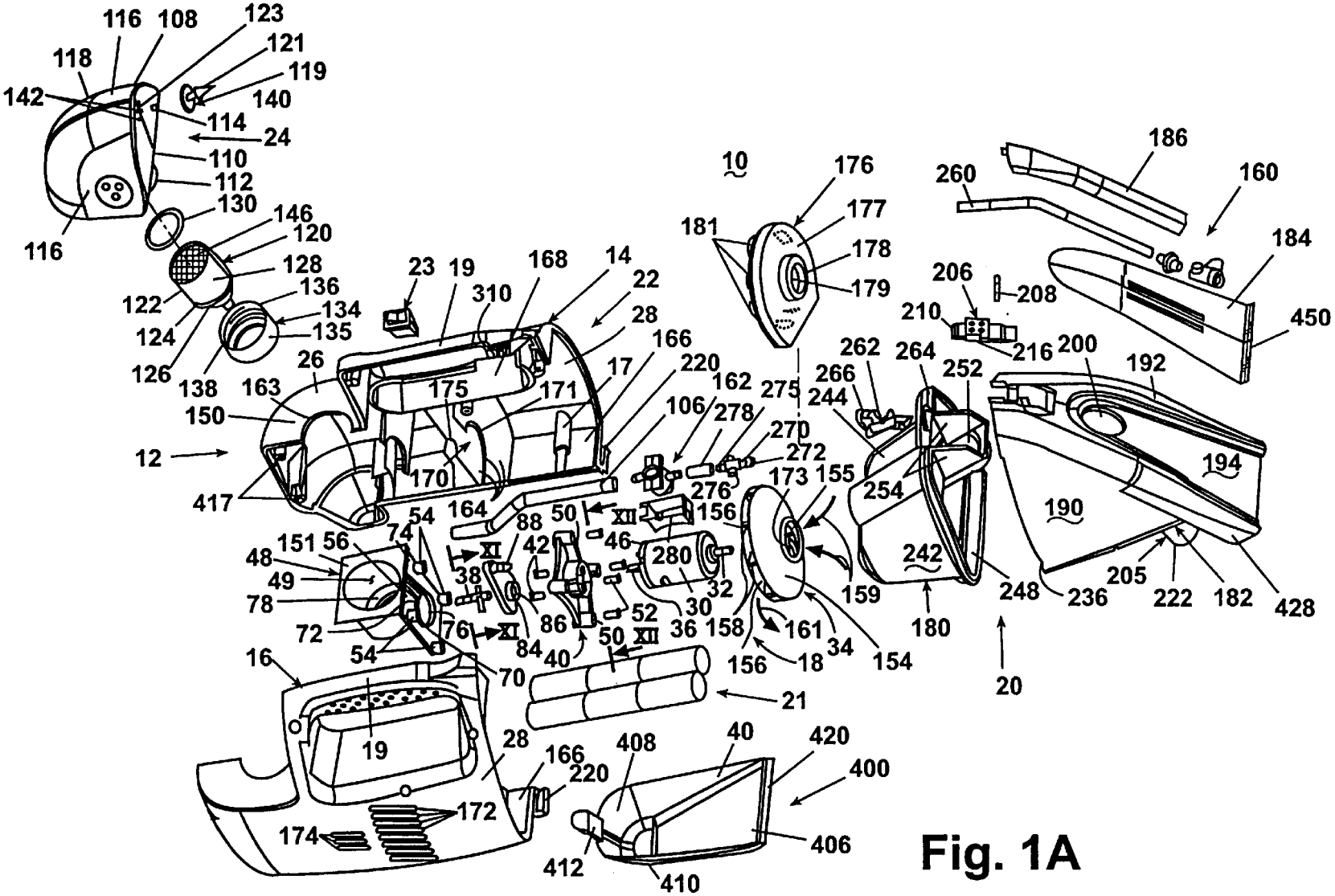
FIG. 1A is an exploded perspective view of the portable, handheld extraction cleaner of FIG. 1.

Referring now to FIGS. 1, 1A and 2, a portable, handheld extraction cleaner 10 comprises a housing 12 having a first shell half 14 and a second shell half 16 that, when mounted together, houses a fluid collection and distribution pump assembly 18. A recovery tank assembly 20 is mountable to a forward end 22 of the housing 12 while a cleaning fluid supply tank 24 is mountable to a rearward portion 26 of the housing.

Each shell half 14, 16 includes a number of bosses 17 that are in alignment with corresponding bosses in the other shell half. The shell halves are preferably fastened together by installing threaded fasteners in the bosses in a well known manner to enclose the pump assembly 18 and a battery pack 21 for supplying electrical power to the pump assembly. Each shell half also includes an integrally molded handle portion 19. An On/Off switch 23 is preferably mounted in an aperture formed in an upper wall 168 below the handle portion 19 in the first shell half 14. The switch 23 is connected between the battery pack 21 and an electric motor 30 for alternately starting and stopping the motor.

The fluid collection and distribution pump assembly 18 is located between the side walls 28 of the shell halves 14, 16 and includes the electric motor 30 having a front shaft portion 32 that mounts a front fan impeller or blower 34 for rotation therewith, and a rear shaft portion 34 that mounts a rear impeller 38 for rotation therewith. The motor 30 is attached to the front side of a mounting bracket 40 through a pair of screw-type fasteners 42 that extend through apertures 44 (FIG. 12) in the mounting bracket and thread into a rear housing portion 46 of the motor. A receptacle 48 for mounting the solution tank 24 is attached to the rear side of the mounting bracket 40 through four screw-type fasteners 52 that extend through apertures 50 in the mounting bracket and thread into bosses 54. The bosses 54 are preferably integrally molded with a front wall 56 of the receptacle 48 and project forwardly therefrom. The receptacle 48 has a circular side wall 49 and an annular bottom wall 51. (See FIG. 5.)

Figure 12:
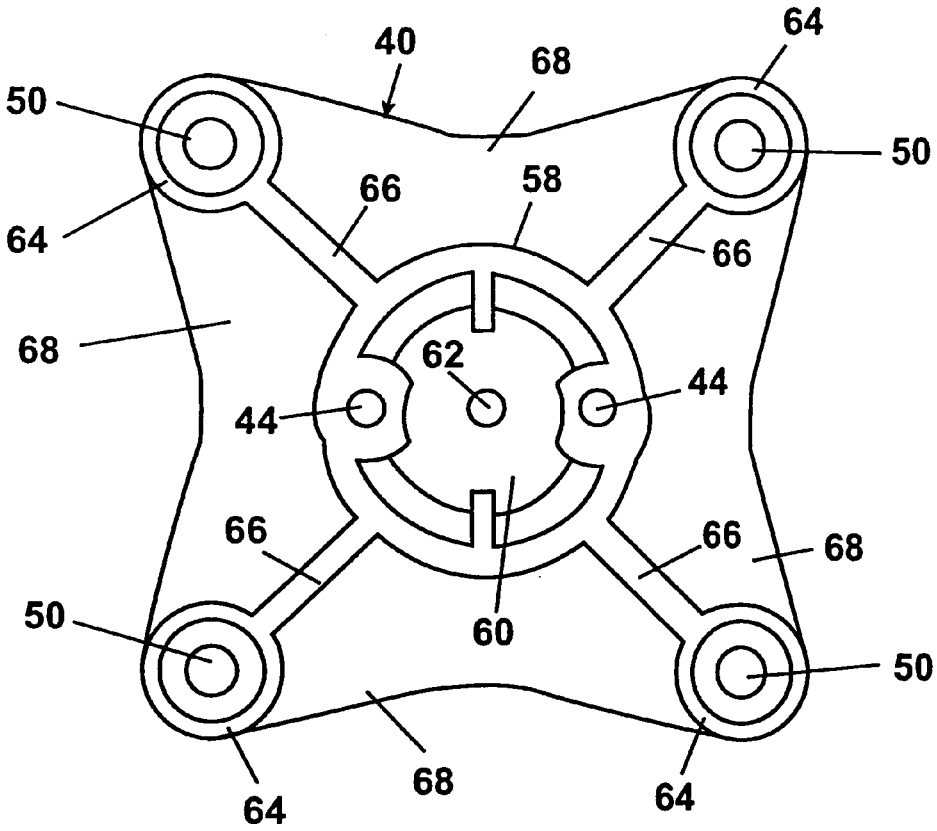
FIG. 12 is a front elevational view of a motor mounting bracket taken along line XII—XII of FIG. 1.

As illustrated in FIG. 12, the mounting bracket 40 includes a central hub 58 through which the apertures 44 extend and a central web portion 60 that can be integrally formed with the central hub 58. An aperture 62 extends through the central web portion for receiving the rear shaft 36 of the motor 30. Preferably, the inner diameter of the aperture 62 is larger than the outer diameter of the rear shaft 36 for free rotation of the shaft within the aperture 62. Each of the apertures 50 is surrounded by a boss 64. A radially extending arm 66 connects each boss 64 to the central hub 58 while outer web sections 68 extend between adjacent bosses 64 and the central hub 58.

Turning again to FIGS. 1A and 2, a continuous wall 70 projects forwardly from the front wall 56 of the receptacle 48 and defines a fluid pumping chamber 72. The chamber 72 includes a narrow channel 74 extending upwardly from a circular outlet opening 76. The outlet opening 76 is in fluid communication with an interior compartment 78 located at a bottom of the receptacle 48 through a passage 77. The interior compartment 78 includes a bottom wall 80 with a pin-type valve actuator 82 projecting upwardly therefrom for a purpose to be explained in greater detail below and a cylindrical rim 87. A cap 84 of the receptacle 48 is attached to the front wall 56 through adhesives, ultrasonic welding, or other well-known technique to enclose the fluid pumping chamber 72 and the rear impeller 38. The rear shaft 36 of the motor 30 extends through an aperture 86 in the cap 84. A collar 90 encircles the aperture 86 and is sized to fit within the central hub 58 of the mounting bracket 40. A seal 88, such as an O-ring, is mounted on the collar 90 and sealingly engages the central hub 58 and the rear shaft 36 to prevent the escape of cleaning fluid into the motor 30. A hollow connector 102 projects forwardly from the cap 84 and is in fluid communication with the narrow channel 74. A barbed termination 104 is formed on a free end of the connector for receiving the rearward end of a fluid supply hose 106 in a well-known manner.

Figure 11:
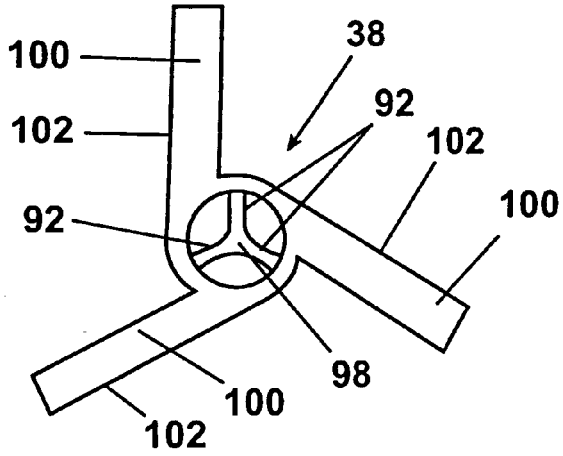
FIG. 11 is a rear elevational view of an impeller taken along line XI—XI of FIG. 1.

With additional reference to FIG. 11, the rear impeller 38 features a cylindrical front portion 94 having a central axis 98 and a rear portion 96. In the preferred embodiment, the rear portion 96 comprises three axially extending blades 92 joined to each other at the central axis 98 and projecting radially therefrom. The front portion 94 also includes three elongate blades 100 that are spaced evenly around the cylindrical front portion 94. An outer edge 102 of each blade 100 preferably extends tangentially to the cylindrical front portion 94. In use, operation of the motor 30 causes the simultaneous rotation of the axially extending blades 92 and the elongate blades 91 of the rear impeller 38. Rotation of the axially extending blades causes liquid to be drawn from the interior compartment 78 of the receptacle 48 toward the fluid pumping chamber 72 where the elongate blades 100 are housed. Rotation of the elongate blades in turn causes the liquid to lift upward through the narrow channel 74 and into the supply tube 106 through the hollow finger 102.

Figure 4:
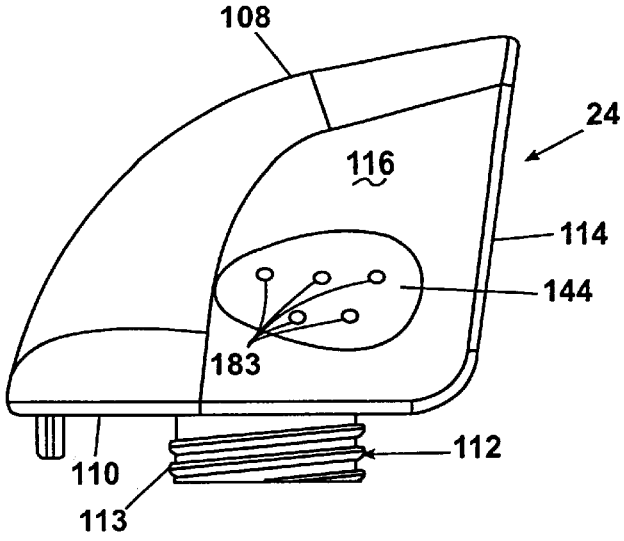
FIG. 4 is a side elevational view of the cleaning solution tank.

As shown in FIGS. 1A and 4, the fluid supply tank 24 comprises a hollow tank body 108 with a lower wall 110 having an outlet opening extending therethrough that is surrounded by a spout 112 having external threads 113. A front wall 114 of the tank 24 is formed integrally with, and extends upwardly from the lower wall 110, preferably at an obtuse angle with respect to the lower wall. A pair of sidewalls 116 are integrally formed with the front and lower walls 114, 110 and are joined together at a common seam 118. An umbrella valve 119 is installed on the front wall 14 of the tank 24 at an upper portion thereof. The umbrella valve 119 includes a mounting stem 121 that extends through an aperture 123 in the wall 114 and a flexible flange portion 140 that seats against an interior surface of the front wall 114 and covers a set of apertures 142 that surrounds the aperture 123. The umbrella valve 119 serves to replenish the tank 24 with air as cleaning fluid is drained from the tank. If the tank 24 is fill or if the tank is tilted such that cleaning fluid rests against the inner surface of the front wall 114, the flexible flange portion 140 will press against the inner surface to thereby seal the apertures 142 from the cleaning fluid. Each sidewall 116 of the tank 24 preferably includes a depression 144 with nubs 183 extending therefrom to facilitate handling the container 24 during removal and installation thereof with respect to the housing 12.

Figure 5:
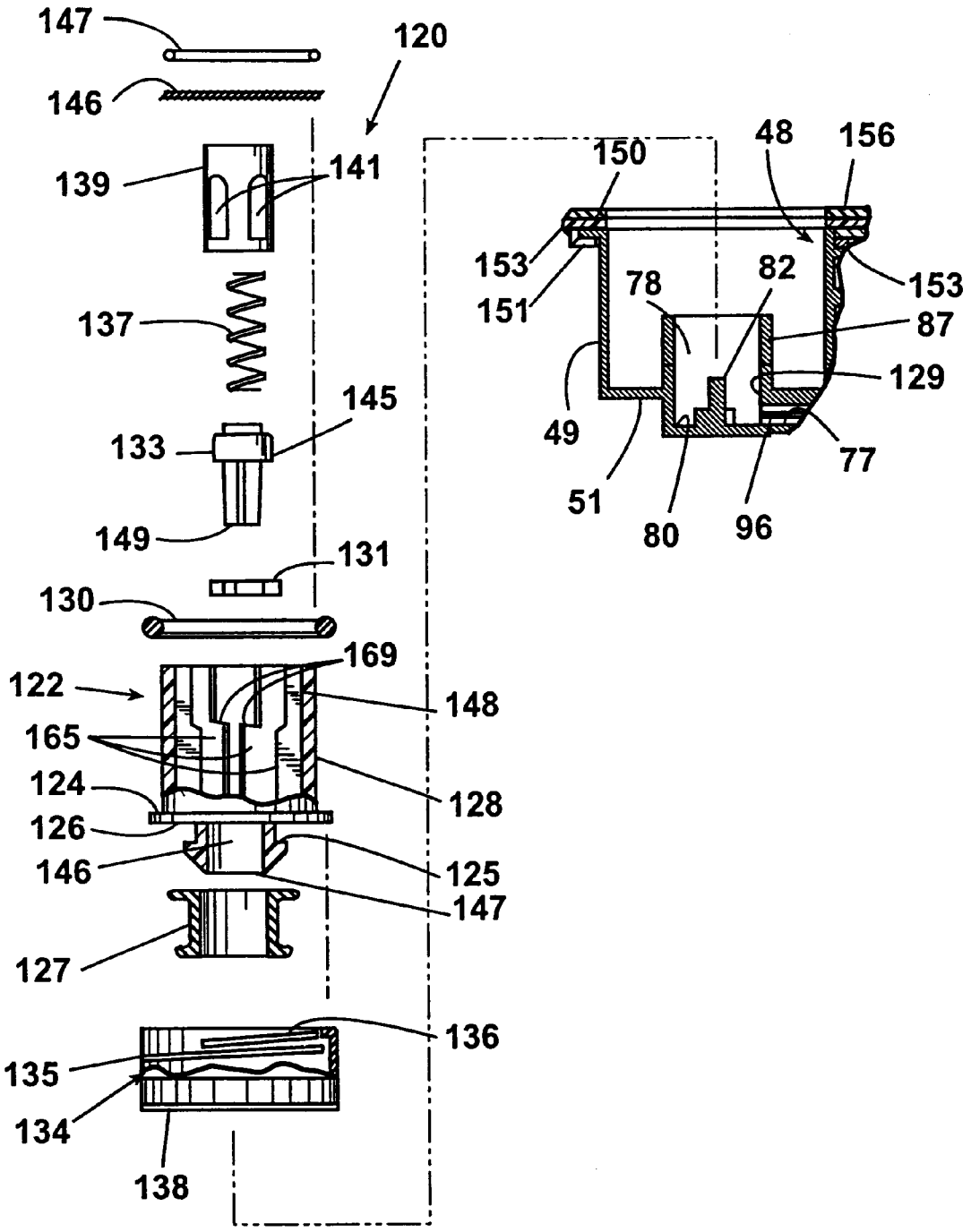
FIG. 5 is an exploded view of a one-way valve for use with the cleaning solution tank.

With additional reference to FIG. 5, a valve assembly 120 adapted to be mounted in the outlet opening of the solution tank 24 includes a valve body 122 having an annular flange 124 formed by the intersection of a bottom wall 126 and an annular wall 128. A gasket 130 is installed around the annular flange 124. The wall 128 is sized to be snugly received within the outlet opening of the threaded spout 112 with the gasket seated against a lower edge 132 of the spout. A collar 134 has an annular wall 135 with internal threads 136 and a bottom wall 138 integrally formed with the annular wall. The internal threads 136 mate with the external threads 113 of the spout 112 to sandwich the valve body 122 between the spout lower edge 132 and the collar bottom wall 138.

The valve body 122 is hollow with a downwardly extending connector boss 125 and a fluid flow aperture 146 extending therethrough. A plurality of ribs 165 extend radially inwardly from the annular wall 128. A shoulder 169 is formed on each rib 165. A flexible rubber seal 127 fits around the boss 125 and is adapted to engage an inner surface 129 of the interior compartment 78 when the valve assembly 120 is installed on the tank 24 and inserted into the receptacle 48. A gasket 131, a release rod or plunger 133 and a compression spring 137 are located within the valve body 122 and held in position by a spring housing 139. A lower end of the spring housing 139 can be securely attached to the inside of the hollow valve body through ultrasonic welding, adhesives, or other well-known means. The spring housing 139 preferably has a plurality of apertures 141 to permit the flow of fluid from the tank 24 therethrough. A screen 143 can be attached to an upper end 148 of the spring housing 139 to filter out large particles of foreign material that may be present in the fluid.

The release rod 133 has an annular flange 145 that seats against the gasket 131 which in turn seats against an upper surface of the bottom wall 126 around the aperture 146 under a biasing force from the spring 137 to prevent the flow of fluid from the tank 24 when it is separated from the interior compartment 78. The bottom of release rod 133 extends beyond the connector boss 125. This structure provides a larger reservoir of fluid to prime the pump.

When the tank 24 is installed on the housing 112, the lower wall 110 is seated against an upper wall 150 formed in the rearward portion 26 of the housing, while the front wall 114 abuts a side wall 152 of the rearward portion 26. In the installed position, the spout 112 extends into the receptacle 48 and the valve actuator 82 pushes the release rod 133 out of sealing engagement with the valve body 122 against a biasing force from the spring 137 to thereby permit fluid to flow from the tank 24 and into the interior compartment 78 where it can be pumped to a spray nozzle assembly 160 mounted to the recovery tank assembly 20 upon actuation of a fluid distribution switch mechanism 162.

The receptacle 48 includes a mounting flange 151 that slides into a pair of spaced support shelves 153 molded into the upper wall 150 of the rearward portion 26 of each shell half 14, 16. An opening 163 is formed in the upper wall 150 in alignment with the open top of the mounted receptacle 48. The diameter of the opening 163 is preferably substantially equal to the inner diameter of the receptacle 48 and the outer diameter of the collar 134. An elastomeric gasket 185 is mounted between upper wall 150 and the mounting flange 151 to seal opening between the mounting flange 151 and the upper wall 150.

Referring again to FIGS. 1A and 2, a vacuum source is provided by the front impeller 34, which includes a front curved plate 154 having an air inlet 155, a rear plate 156 spaced from the front plate 154 with an opening 157 for receiving the front shaft 32 of the motor 30, and a plurality of ribs 158 located in the space between the front and rear plates. Preferably, each rib 158 curves radially outwardly from the air inlet 155 to draw air into the inlet 155 from the recovery tank assembly 20, as represented by direction arrows 159, and expel the air from between the plates, as represented by direction arrows 161. A diffuser 176 is positioned over the front plate 154 of the front impeller 34. The diffuser 176 includes a front plate 177 with an annular collar 178 that surrounds an opening 179 in the front plate 177. A plurality of ribs 181 extend rearwardly from a rear surface of the front plate 177. As shown in FIG. 2, the ribs 181 contact the front plate 154 of the impeller 34 with the opening 155 coincident with the opening 179.

Each shell half 14, 16 has a pair of spaced, parallel housing ribs 164, 165 that are integrally molded along three sides to a lower wall 166, the side wall 28, and the upper wall 168 below the handle portion 19. The housing ribs serve as reinforcement members for the shell halves and also define an internal compartment 170 that houses the front impeller 34 and diffuser 176. The front housing rib 164 has a semi-circular opening 171 that receives the collar 178 of the diffuser 176. The rear housing rib 165 also has a smaller semi-circular opening 175 that receives the front shaft 32 of the motor 30. The openings are coaxial with each other. A plurality of elongate exhaust apertures 172 extend through each shell half 14, 16 and communicate with the internal compartment 170 to permit air to escape from the internal compartment when the front impeller 34 is operating. A plurality of exhaust apertures 174 can also be provided in the shell halves adjacent the exhaust apertures 172 to prevent excessive heat build-up in the motor 30 during operation and excessive heat build-up in the housing 12 during recharging of the battery pack 21. The lower wall 166 of the housing 12 includes a hollow foot portion 167 that maintains the hand-held extraction cleaner 10 in a substantially horizontal position when not in use.

Figure 3:
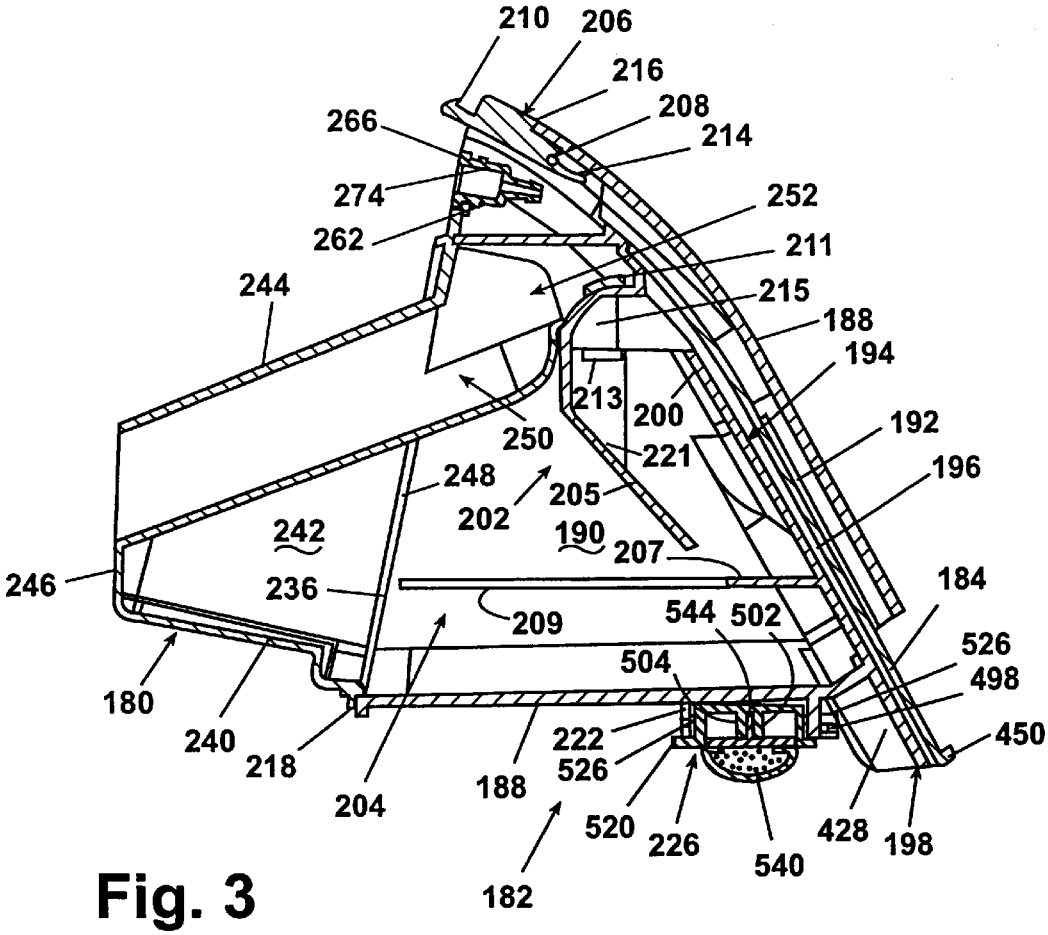
FIG. 3 is an enlarged cross sectional view of the recovery tank assembly and a brush assembly mounted thereto.

With reference also to FIG. 3, the recovery tank assembly 20 includes a rear tank section 180 attached to a front tank section 182, a channel cover 184 and a nozzle cover 186. The front tank section 182 has a bottom wall 188, a pair of side walls 190 and a sloping front face 192. A channel 194 is formed in the front face 192. The channel cover 184 fits snugly over the channel 194 to form an enclosed suction conduit 196 with a suction nozzle opening 198. An inlet opening 200 is formed in the front face 192 into the interior chamber 204 of the front tank section 182.

A curved deflector 202 extends into the interior chamber 204 from the front face 192 to deflect air, liquids and debris downwardly within the interior chamber. The deflector 202 is an integrally molded one-piece assembly including an arcuate upper portion 203 adjacent the inlet opening 200 to the interior chamber 204 and a depending portion 205 extending downwardly into the interior chamber 204. Both portions 203, 205 include curved sides 215, 221, respectively, to form a generally concave deflector 202 about the inlet opening 200 to channel recovered fluid toward a lower portion of the interior chamber 204. The arcuate upper portion 203 is preferably integrally molded with the housing of the recovery tank assembly 20. The depending portion 205 includes a strap 211 and a tab 213 connecting the depending portion 205 to the arcuate upper portion 203. The strap 211 extends over the arcuate upper portion 203 to support the depending portion 205, which is preferably snap fit over the arcuate upper portion 203. The tab 213 secures the snap-fit connection by slipping under a lower edge of the arcuate upper portion 203.

A horizontal baffle 207 in a lower portion of the interior chamber 204 and below the depending portion 205 of the deflector 202 blocks sloshing of recovered fluid toward the inlet opening 200 and prevents the generation of foam in the interior chamber 204. The horizontal baffle 207 includes openings 209 permitting the collection and rise of recovered fluid within the interior chamber 204.

A latch 206 is pivotably mounted to an upper portion of the front face 182 through a pin 208 for releasably mounting the recovery tank assembly 20 to the housing 12 of the extraction cleaner 10. The latch 206 includes a retaining finger 210 that engages behind a flange 212 projecting downwardly from the handle portion 19. A lever arm 214 extends in a direction opposite the retaining finger 210 and contacts an inner surface of the nozzle cover 186 to bias the retaining finger into engagement with the flange 212. A release button 216 is integrally formed between the retaining finger 210 and lever arm 214. To release the recovery tank assembly 20 from the housing 12, the release button 216 is pressed inwardly against the bias of the lever arm 216 until the retaining finger 210 is clear of the flange 212. The recovery tank assembly 20 can then be rotated clockwise, as shown in FIG. 2 until it is separated from the housing 12. The bottom wall 188 of the front tank section 182 includes a downwardly extending flange 218 that seats in a grooved support member 220 integrally molded to the lower wall 166 at the forward end 22 of each shell half 14, 16. As shown in FIG. 21A, the flange 218 includes a ramp 219 defining an interior edge 217. The flange 218 seats in the support member 220 with the edge 217 blocking dislocation from the support member 220 and providing a pivot point for rotation of the recovery tank assembly 20 relative the grooved support member 220 of each shell half 14, 16.

A brush holder 205 is also formed in the bottom wall 188 of the front tank section 182. The brush holder has a continuous wall 222 that defines an inner compartment 224 into which the mounting base 226 of a brush assembly 228, 230, 232 (FIGS. 16–18) can be mounted. A pair of side flanges 428 are preferably formed with the front face 192 and side walls 190 to reinforce the front face 192 against forces that may be generated during surface cleaning.

The front tank section is open at a rearward portion 236 thereof and is attached to the rear tank section, preferably through ultrasonic welding. However, fasteners, adhesives, or other well known attaching techniques can be used.

The rear tank section 180 comprises a bottom wall 240, side walls 242, a top wall 244 and an end wall 246. The forward end 248 of the rear tank section 180 is open as illustrated in FIG. 1A. An air conduit 250 is formed beneath and as a part of the top wall 244 extending from the end wall 246 and into the front tank section 182. The air conduit 250 has a first open end 252 defined by side plates 254 at the forward end 248 of the rear tank section and a second open end 256 extending through the end wall 246. The side plates 254 assist in preventing any liquid that may be entrained in air to be drawn through the opening 200 and enter the air conduit 250. The suction nozzle opening 198, the suction conduit 196, the interior of the front and rear tank sections 182, 180, and the air conduit 250 are in fluid communication with each other and the vacuum source created by the front impeller 34 to draw air and entrained liquid and debris from the surface being cleaned and deposit the liquid and debris in the interior of the recovery tank when the electric motor 30 is operating.

Figure 10:
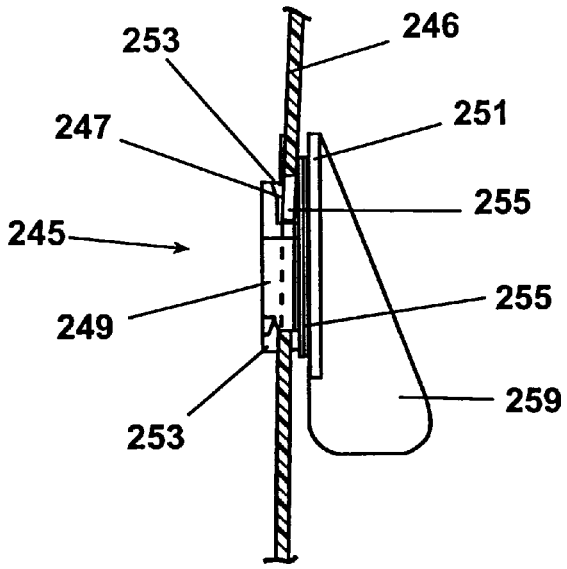
FIG. 10 is a left side elevational view of a recovery tank drainage cap.

As shown in FIG. 10, a removable drain cap 245 can be provided in an opening 247 formed in the end wall 246 for draining any liquid in the recovery tank that may be collected in the interior of the rear tank section 180 and the front tank section 182. The drain cap 245 includes a continuous side wall 249 integrally formed with an end wall 251. Locking tabs 253 extend circumferentially around the side wall 249 and project outwardly therefrom. The locking tabs 253 engage behind flanges 255 that project into the opening 247 from the end wall 246. Preferably, three locking tabs 253 are spaced equidistant around the circumference of the side wall 249 for engaging three corresponding flanges 255. Each locking tab 253 has a chamfered surface 257 that engages its corresponding flange 255 and pulls the end wall 251 toward the end wall 246 to thereby seal the cap 245 to the end wall 246. If desired, further sealing can be accomplished by installing an O-ring (not shown) on the drain cap 245 at the intersection of the side wall 249 and end wall 251. A handle 258 is integrally formed with the end wall 251 to facilitate removal and installation of the drain cap 245.

In the preferred embodiment, the recovery tank is designed to have a capacity of about 20 ounces, whereas the solution tank has a capacity of about eight ounces. It is contemplated that with normal use of the handheld extraction cleaner, the liquid collected in the recovery tank will be eight ounces or less before emptying. Further, if the extraction cleaning machine is held vertically for cleaning vertical surfaces for example, the liquid will collect principally in the rear tank section 180 and ordinarily will not enter the opening 252 in the air conduit 250.

The adjustable spray nozzle assembly 160 is mounted to the channel cover 184 and is attached to one end of a tube 260 which extends under the nozzle cover 186 to deliver cleaning solution to a carpet to be cleaned. The other end of the tube 260 is attached to a female connector 262, a portion of which extends through an opening 264 in the forward portion 236 of the rear tank section 180. A flange 266 and opposing circumferentially spaced barbs 288 lock the connector 262 in the opening 264. A male connector 270 includes a first end 272 that is sealingly received in a receptacle 274 of the connector 266 and a second barbed connector end 275 that is attached to the forward end of a flexible tube 278. The flexible tube 278 in turn is connected to the trigger mechanism 162 to deliver cleaning fluid under pressure to the spray nozzle assembly 160 when the trigger mechanism is depressed. A pair of pivot pins 276 are located between the first and second ends 272, 275 of the male connector 270 and extend into apertures (not shown) in the housing for pivotally mounting the male connector to the housing. As described above, the recovery tank assembly pivots into locking engagement with the forward end 22 of the housing 12. The pivoting action of the male connector 270 assures that it will be aligned with the female connector 262 without binding when the recovery tank assembly 20 is mounted to and removed from the housing. In this manner, the coupling and uncoupling of the male and female connectors 262, 264 is greatly facilitated because of the seal required and because of the pivoting motion of the tank.

Figure 6:
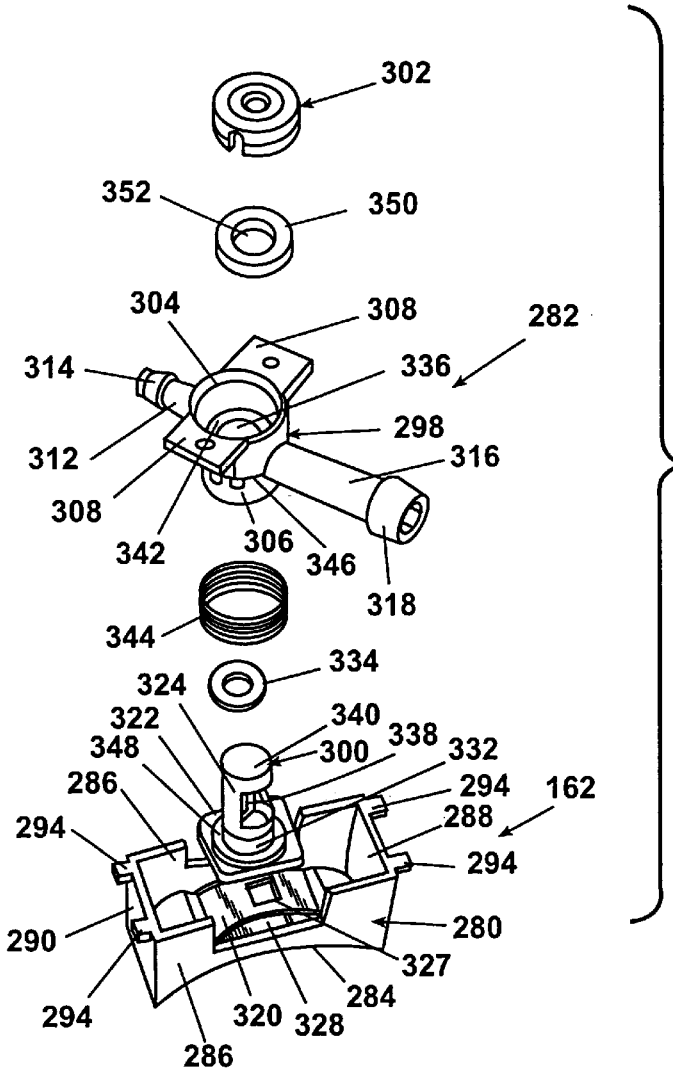
FIG. 6 is an exploded perspective view of a fluid distribution switch.

With reference now to FIGS. 2 and 6, the trigger mechanism 162 includes an actuator button 280 that controls the opening of a normally closed valve assembly 282. The actuator button has a lower curved wall 284 connected to a pair of side walls 286 and front and rear walls 288, 290. The actuator button 280 fits into an opening 292 in the handle portion 19. Tabs 294 formed on the upper edge of the front wall 288 and rear wall 290 rest against a lower inner surface 296 of the handle portion 19 under a bias force from the valve assembly 282 to limit the downward travel of the actuator button.

The valve assembly 282 comprises a valve body 298, a spring-loaded plunger 300 mounted for reciprocation with respect to the valve body 298, and a valve cap 302. The valve body 298 includes a cup-shaped casing 306 having a pair of mounting tabs 308 projecting laterally from an upper portion 304 of the casing. The tabs 308 extend into corresponding slots 310 (FIG. 1A) in the shell halves 14, 16 when assembled together. A hollow connector 312 projects rearwardly from the upper portion of the casing 306. A barbed termination 314 is formed on a free end of the connector 312 for receiving the forward end of the fluid supply hose 106 in a well-known manner. A hollow connector 316 projects forwardly from a mid portion of the casing 306 and also includes a barbed termination 318 for receiving the rearward end of the tube 278. The plunger 300 has a base 322 and a valve stem 324 projecting upwardly from the base. A nub 326 (FIG. 2) projects downwardly from a lower surface of the base. The lower surface of the base is in engagement with a leaf spring 320 located in a depression 328 formed on the inner surface 330 of the lower curved wall 284 to bias the actuator button downwardly out of the handle portion 19. The nub 326 projects through an aperture 327 in the leaf spring. This arrangement assures that the actuator button 280 remains in alignment with the plunger 300 during reciprocal movement of the button and plunger.

The valve stem 324 includes an annular groove 332 that receives an O-ring 334. The O-ring 334 rides along an inner surface 336 of the casing 306 for slidably sealing the plunger 300 against the casing during reciprocation of the plunger within the casing to insure that liquid within the casing does not leak past the plunger and collect in the actuator button 280. An opening 338 extends radially through the valve stem 324. A sealing washer 350 is sandwiched between a lower edge 352 of the cap 302 and an inner annular ledge 342 of the casing 306. A compression spring 344 has an upper end that seats against an outer annular ledge 346 and a lower end that seats against an annular spring seat 348 on the base 322 to bias the plunger 300 downwardly with respect to the valve body 298. An upper end of the valve stem includes a head 340 that reciprocates within an opening 352 of the washer 350 when the actuator button is pressed and released. Preferably, an outer diameter of the head 340 is substantially equal to an inner diameter of the washer 350, and the height of the valve stem is chosen such that the valve head is in sealing engagement with the washer 350 when the plunger 300 is in its fully extended position to seal the casing 306 against the entry of fluid under pressure from the tube 106. When the actuator button 280 is depressed, the plunger 300 moves upwardly to break the seal between the plunger head 340 and the sealing washer 350. In this position, cleaning fluid pumped from the supply tank 24 passes through the opening 338 in the valve stem 324 and is delivered under pressure to the spray nozzle 160 via the tube 278, connectors 262, 270 and the tube 260. When it is desired to stop the flow of cleaning fluid to the spray nozzle, pressure on the actuator button 280 is released, whereupon the valve head 340 returns to its initial position in sealing engagement with the washer 350 under bias from the spring 344. Pressure from the fluid acting on an upper surface of the valve head additionally encourages the valve head to return to its initial position.

Figure 7:
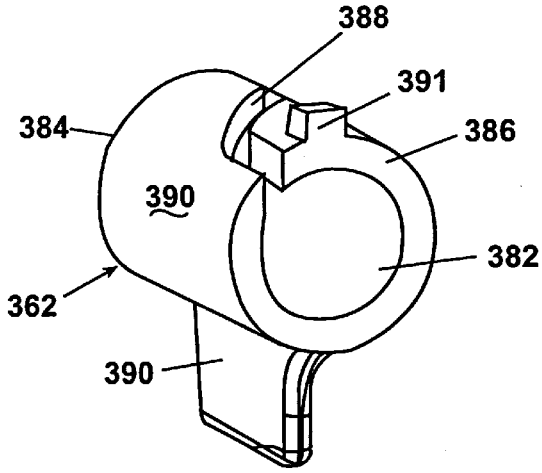
FIG. 7 is an enlarged perspective view of an adjuster collar for a spray nozzle assembly according to the invention.
Figure 8:
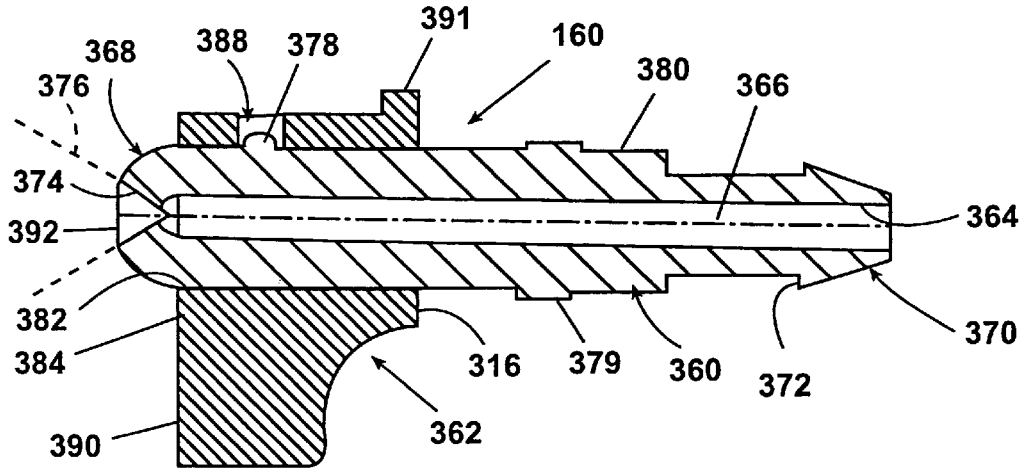
FIG. 8 is a cross sectional view of the spray nozzle assembly with the adjuster collar in a first position.
Figure 8A:
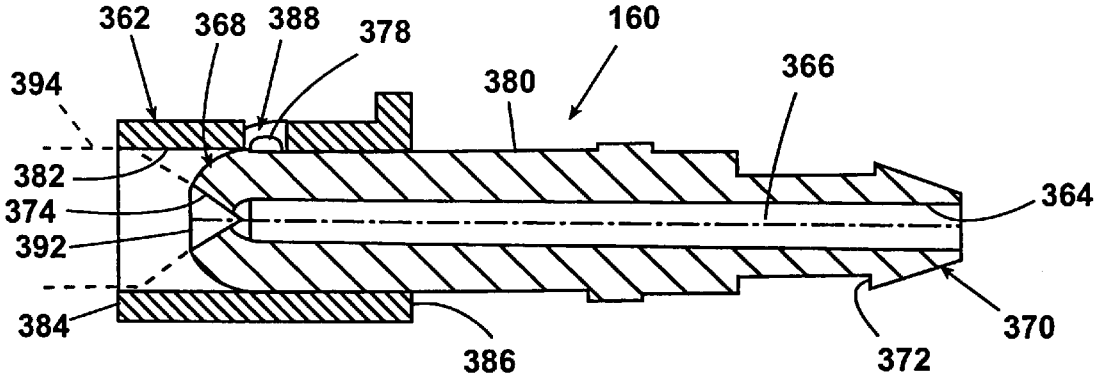
FIG. 8A is a cross sectional view similar to FIG. 7 showing the adjuster collar in a second position.

Referring now to FIGS. 7, 8 and 8A, the adjustable spray nozzle assembly 160 includes a nozzle body 360 and an adjustable controller preferably comprising a collar 362 rotatably connected to the nozzle body 360. The nozzle body 360 is preferably substantially cylindrical in cross section with a central axis 366. A bore 364 extends entirely through the nozzle body 360 from a first nozzle end 368 to a second connector end 370, and preferably along the central axis 366. The collar 362 moves axially between a first and second position relative the nozzle end 368 for varying the focus of the spray pattern. A barb 372 is formed at the second end 370 for connection to the tube 260 (FIG. 1A). A fan-shaped nozzle opening 374 is formed at the first end 368 for normally delivering fluid under pressure to a surface to be cleaned in a fan-shaped pattern 376. The nozzle body 360 also includes nub 378 and a mounting collar 379 projecting from an outer surface 380 of the nozzle body 360. The mounting collar is adapted for attachment to the channel cover 184 (FIG. 1A) in order to secure the nozzle body against movement.

The spray adjuster collar 362 includes a first end 384 and a second end 386. A bore 382 extends from the first end 384 to the second end 386 and is sized to receive the first nozzle end 368 of the nozzle body 360. A helical groove 388 preferably extends from an outer surface 390 of the spray adjuster collar 362 and communicates with the bore 382. The nub 378 of the nozzle body 360 is received within the groove 388 to control rotational and axial movement of the adjuster collar with respect to the nozzle body. Preferably, the circumferential length of the groove 388 is sized to allow rotation of the adjuster collar through about 90°. A lever 390 is formed with the adjuster collar 362 and can be grasped by a user for rotation about the central axis 366 to adjust the relative axial position of the first end 384 of the adjuster collar 362 with respect to the nozzle opening 374. A tab 391 is also formed with the adjuster collar opposite the lever 390. The tab 391 is adapted to abut the channel cover 184 to provide a positive stop for the adjuster collar at its rotational limit.

As shown in FIG. 8, the first end 384 of the adjuster collar is substantially flush with the apex of the nozzle opening 374 in one position of the adjuster collar. In this position, fluid under pressure travels through the bore 364 and exits the nozzle opening 374 in a substantially unimpeded fan-shaped or conical pattern 376. When the adjuster collar is rotated to a position as shown in FIG. 8A, the inner surface of the bore 382 interferes with the fan-shaped pattern of fluid exiting the nozzle to produce a relatively flat stream 394 of fluid exiting the bore 382. The adjuster collar can also be rotated to intermediate positions between the positions shown in FIGS. 8 and 8A to adjust the width of the fan-shaped or conical pattern.

Figure 9:
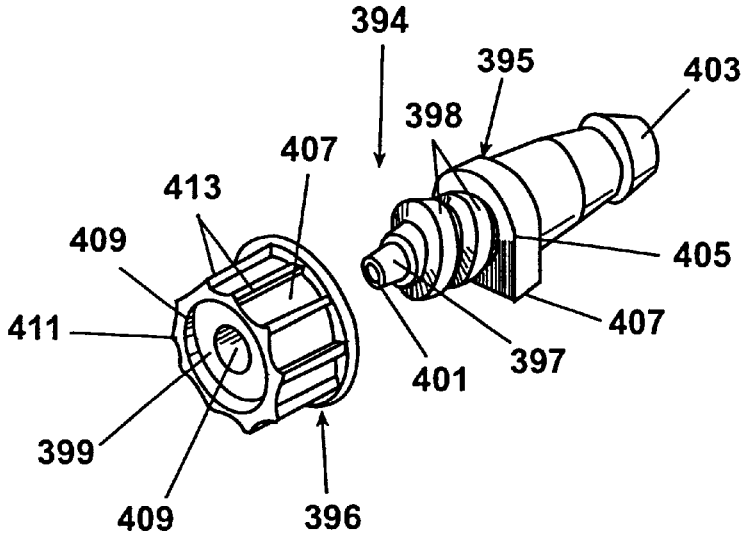
FIG. 9 is an exploded perspective view of a spray nozzle assembly according to a second embodiment of the invention.

With reference now to FIG. 9, an adjustable spray nozzle assembly 394 according to a second embodiment of the invention is illustrated. The adjustable spray nozzle assembly 394 includes a hollow nozzle body 395 and an adjuster cap 396. The nozzle body has a first end with a spray tip 397 and external square-shaped threads 398. The spray tip 397 preferably includes a fan-shaped spray orifice 401 for distributing cleaning fluid to a surface in a fan-shaped pattern. The threads 398 mesh with internal threads (not shown) on the adjuster cap 396 for rotational and axial adjustment of the cap 396 on the nozzle body 395. A second end of the nozzle body has a barbed termination 403 for connection to the fluid supply tube 260. A support flange 405 is formed between the first and second ends and includes a lower angled surface 407 that is supported on the upper surface of the channel cover 184. The adjuster cap 396 includes an end wall 399 integrally formed with a continuous inner wall 411 which is in turn integrally formed with a continuous outer wall 407. An aperture 409 is formed in the end wall 399 for receiving the spray tip 397. As with the previous embodiment, rotation of the cap 396 on the nozzle body 395 causes axial movement of the cap with respect to the nozzle body. Depending on the relative axial position of the adjuster cap 336 and the spray orifice 401, the inner wall 411 interferes with the fan-shaped pattern of fluid exiting the nozzle to produce a stream of fluid exiting the orifice 401. The adjuster cap can also be rotated to intermediate positions to adjust the width of the fan-shaped pattern. The adjuster cap 396 can include ribs 313 formed on an outer surface thereof to strengthen the cap and facilitate adjustment of the cap by a user.

Various accessory tools can be removably mounted to the housing 12 or the recovery tank assembly 20. The accessories include a scoop 400 shown in FIGS. 1A and 2, a squeegee tool 402 shown in FIG 13, a crevice tool 404 shown in FIG. 14, and the brush assemblies 228, 230 and 232 shown in FIGS. 16, 17 and 18, respectively.

With reference again to FIGS. 1A and 2, the scoop 400 includes a lower slanted wall 406 integrally molded to a rear wall 408 and a pair of side walls 410. A spring latch 412 extends upwardly from the rear wall 408 and fits within a slot 414 in the lower wall 166 of the housing 12. An upper end of the spring latch 412 has a hook 416 that contacts the inner surface of the lower wall 166. A retaining finger 418 extends downwardly from the bottom wall and is adapted to support a forward edge 420 of the scoop 400. A tab 426 projects rearwardly from the spring latch 412. The tab 426 has opposed surfaces that can be grasped by a user to push the spring latch 412 forwardly for releasing the scoop 400 from the lower wall 166. The scoop 400, when released from the lower wall 166 can be used in conjunction with one or more of the brush assemblies 228, 230, 232 that either can be mounted to or detached from the recovery tank assembly 20 in order to pick up debris that would otherwise be too large to fit through the suction nozzle opening 198.

Figure 13A:
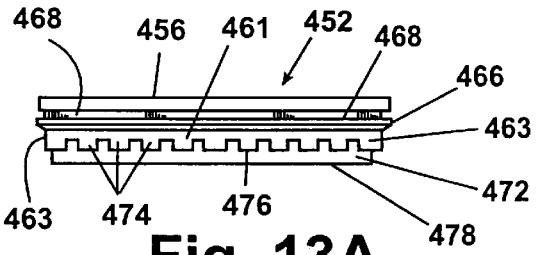
FIG. 13A is a rear elevational view of the nozzle insert of FIG. 13.
Figure 13:
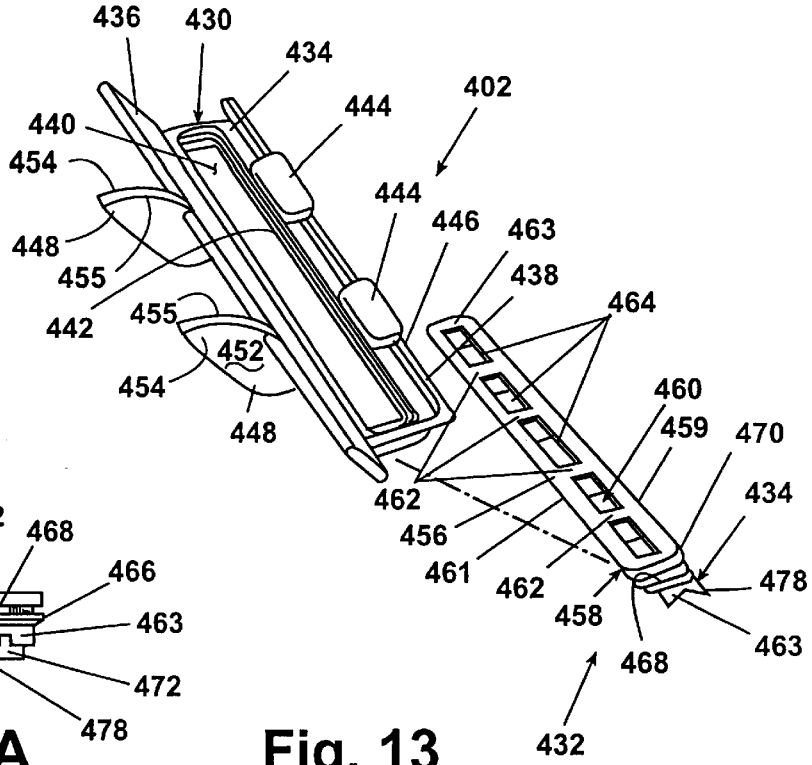
FIG. 13 is an exploded top perspective view of a squeegee accessory having a mounting base and nozzle insert according to the invention for attachment to the recovery tank assembly.

With reference now to FIG. 13, the squeegee tool 402 comprises a mounting base 430 and a nozzle insert 432 for attachment to the mounting base. The mounting base 430 has a bottom wall 434 with a rear wall 436 and a front wall 438 extending generally upward from the bottom wall. Preferably, the rear wall 436 and front wall 438 extend at an acute angle with respect to a plane passing through the bottom wall. An elongate opening 440 is formed in the bottom wall and includes a peripheral flange 442 for mounting the nozzle insert 432 within the opening. A pair of mounting tabs 444 extend rearwardly and downwardly from a top edge 446 of the front wall 438 and are adapted to hook over a lower lip 450 of the channel cover 184. (See FIG. 3A). A pair of mounting fingers 448 project rearwardly and upwardly from a rear surface of the wall 436. Each mounting finger 448 has an outwardly facing surface 452 from which a lug 454 extends for snap-fit engagement with a corresponding lug 431 formed on a pair of spaced flanges 433 (FIG. 3B) that extend forwardly from the continuous wall 222. A central flange 435 is formed on the continuous wall between the spaced flanges 433 for limiting the amount of inward travel of the mounting fingers 448.

Figure 3A:
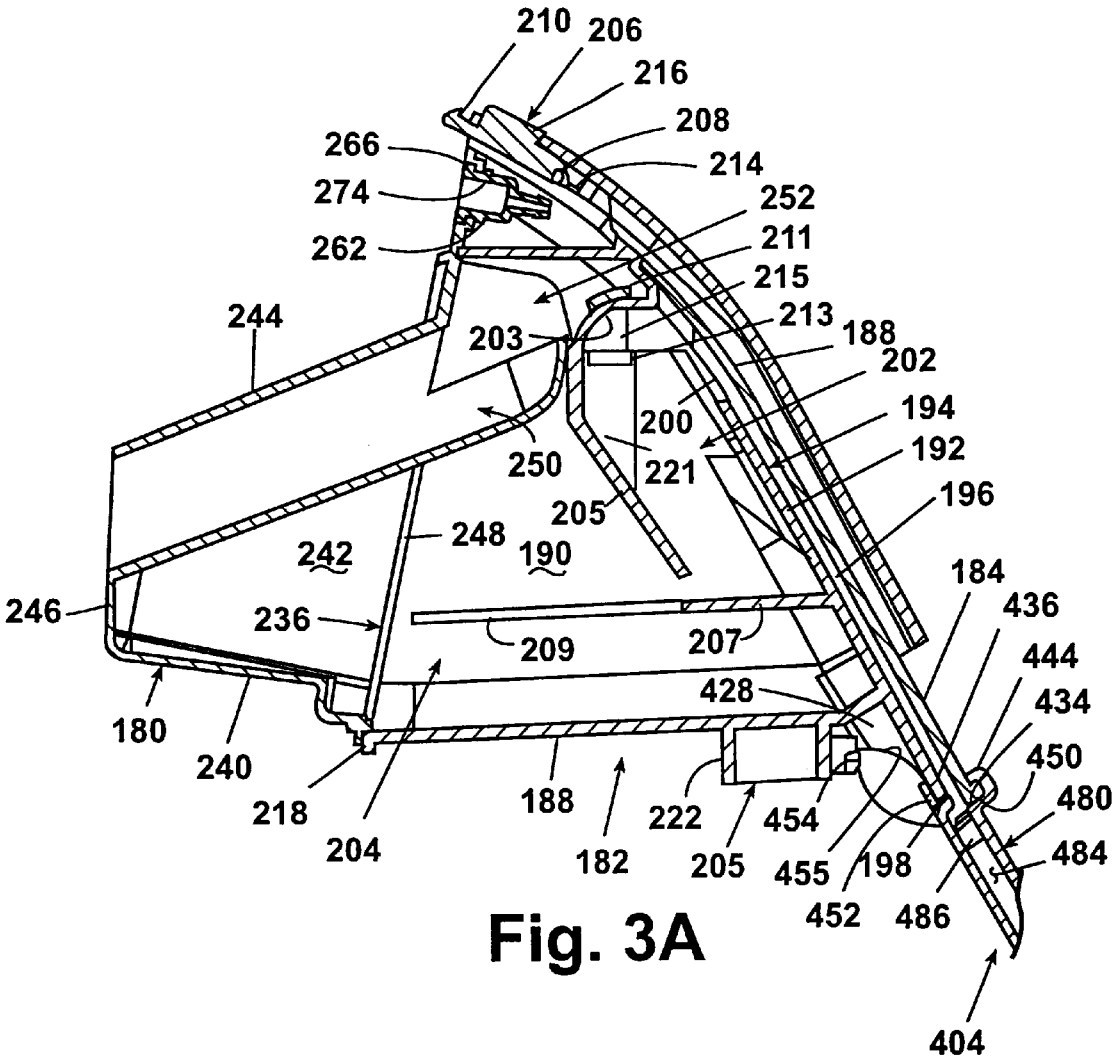
FIG. 3A is an enlarged cross sectional view of the recovery tank assembly and a crevice tool mounted thereto.
Figure 3B:
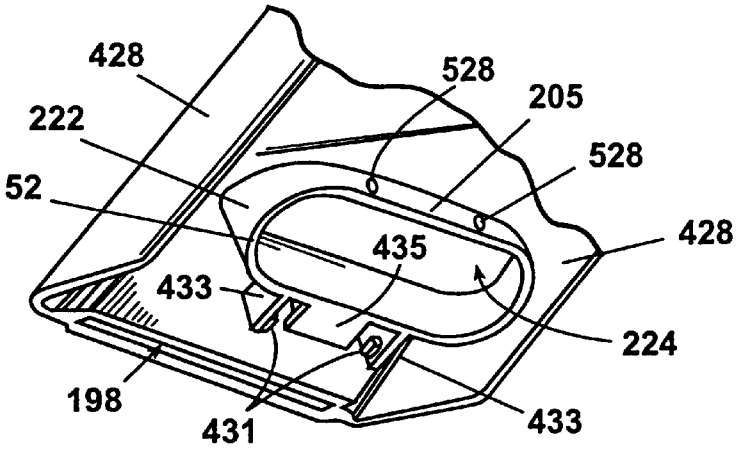
FIG. 3B is a bottom perspective view of a front portion of the recovery tank.

During installation of the mounting base to the recovery tank assembly as illustrated in FIG. 3A, the mounting tabs 444 are booked around the lower lip 450 of the channel cover 184 and then rotated such that a forward cam surface 455 of each finger 448 comes into contact with a lower edge 457 (FIG. 2) of the front face 182.

The cam surfaces are curved to facilitate their sliding movement over the lower edge, and thus rotational movement of the mounting base. In its final position, the cam surfaces are clear of the lower edge 457 and the lugs 454 are locked with their corresponding lugs 431. The mounting base 430 is preferably molded of a polymer material that is sufficiently flexible to allow slight movement of the fingers away from each other during installation and removal of the mounting base on the recovery tank assembly, yet sufficiently stiff to resist forces that may occur during cleaning to prevent the inadvertent removal of the mounting base.

With additional reference to FIG. 13A, the nozzle insert 432 has an upper wall 456 integrally formed with a continuous side wall 458 to form an elongate suction channel 460. The side wall 458 includes a front wall portion 459 connected to a rear wall portion 461 by a pair of lateral wall portions 463. A plurality of ribs 462 are integrally formed with the upper wall 456 and opposed inner surfaces of the front wall portion 459 and rear wall portion 461 to divide the channel 460 into smaller openings 464 and to reinforce the side wall 458. A bead 466 is formed with the outer surface of the continuous side wall 458. The bead 466 is preferably a continuous bead that extends completely around the side wall 458. A groove 468 is formed between an outer peripheral edge 470 of the upper wall 456 and the bead 466. The groove 468 receives the peripheral flange 442 of the mounting base 430 when the nozzle insert 432 is installed in the elongate opening 440. A squeegee 472 is formed as a lower extension of the front wall portion 459. As shown in FIG. 13A, a lower end of the rear wall portion includes spaced projections 474. A lower edge 478 of the squeegee 472 extends below a lower edge 476 of the projections 474. Preferably, the nozzle insert 432 is constructed entirely of an elastomeric material during a single molding operation.

Figure 14:
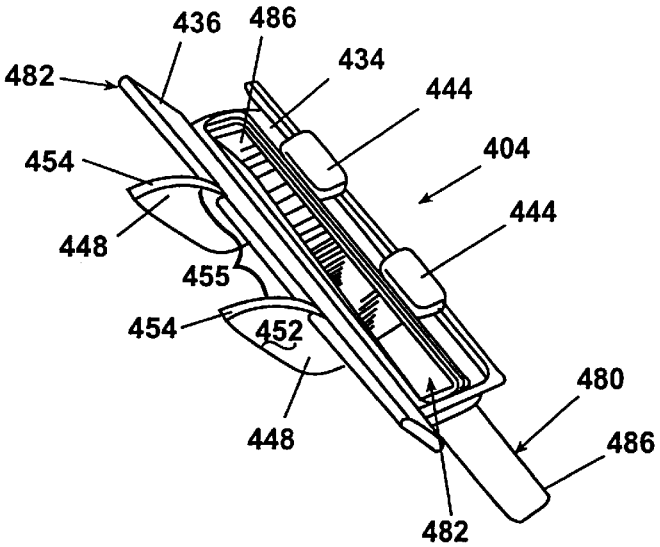
FIG. 14 is a top perspective view of a crevice tool according to the invention for attachment to the recovery tank assembly.

As shown in FIG. 14, the crevice tool 404 comprises a tubular collection nozzle 480 integrally formed with a mounting base 482. The mounting base 482 is similar in construction to the mounting base 430 with like parts being represented by like numerals. A suction channel 484 extends from the elongate opening 440 in the mounting base 482 to an outer free end 486. When the crevice tool 404 is installed on the recovery tank assembly as illustrated in FIG. 3A, the suction channel 484 is in alignment with the suction nozzle opening 198 and the mounting tabs 444 are hooked around the lower lip 450 of the channel cover 184 and the lugs 454 are releasable retained in the grooves behind the spaced flanges 428.

Figure 15:
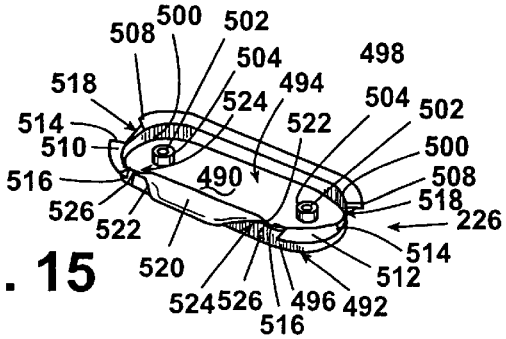
FIG. 15 is a perspective view of a brush mounting base according to the invention.

Turning now to FIG. 15, the mounting base 226 for the brush assemblies 228, 230 and 232 is illustrated. The mounting base 226 includes an upper wall 490 integrally formed with a continuous side wall 492 to form an elongate receptacle 494. The side wall 492 includes a front wall portion 496 connected to a rear wall portion 498 by a pair of curved lateral wall portions 500. A pair of bosses 502 are formed with the upper wall 490 and extend downwardly therefrom. Each boss 502 has a bore 504 extending therein. A first flange section 506 is formed at a lower edge of the rear wall portion 498 and extends part way around the curved lateral wall portions 500, terminating at lateral end edges 508. Second and third flange sections 510, 512 are each formed at a lower edge of the front wall portion 496 and extend part way around the curved lateral wall portions 500, terminating at a lateral end edge 514 and a front end edge 516. A slot 518 is formed between each pair of lateral end edges 514. A handle 520 is formed between the pair of front end edges 516 and includes opposite handle end edges 522 A front slot 524 is formed between each pair of end edges 516 and 522. A nub 526 is formed with the front wall portion 496, preferably below each front slot 524. Each of the nubs 526 are preferably semi-spherical in shape. The mounting base 226 is shaped to be snugly received within the continuous wall 222 of the brush holder 205 (FIGS. 2, 3B) with the nubs 526 positioned in spaced apertures 528 formed in the continuous wall 222. In this position, the handle portion 520 and the flange sections 506, 510, 512 extend over the lower edge 529 of the wall 222. The handle portion 520 can be grasped by a user to facilitate removal of the mounting base 226 from the brush holder 205.

Figure 16A:
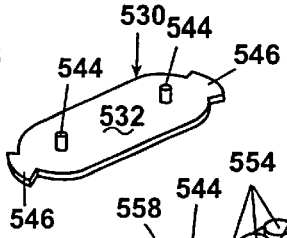
FIG. 16A is a top perspective view of a mounting plate for the brush assembly of FIG. 16.
Figure 16:
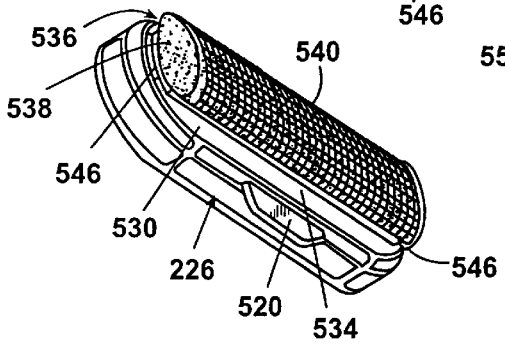
FIG. 16 is a bottom perspective view of a soft scrub brush assembly according to the invention for attachment to the recovery tank assembly.

With reference now to FIGS. 16 and 16A, the scrubbing brush assembly 228 comprises a mounting plate 530 attached to the mounting base 226. A flexible scrubbing head 536 is mounted to a lower surface 534 of the plate 530 through adhesives, fasteners or other well-known fastening means. The scrubbing head includes a pad 538 that is preferably constructed of an open cell foam material and a netting 540 that encircles a substantial portion of the pad.

A pair of pins 544 extend from an upper surface 532 of the mounting plate 530 for insertion into the bores 504 of the bosses 502. A wing section 546 is formed at opposite ends of the mounting plate 530. Each wing section 546 is shaped to fit within one of the slots 518 of the mounting base 226. The mounting plate 530 can be held securely on the mounting base 226 through frictional engagement between the pins and inner surfaces of the bores, adhesives, ultrasonic welding, or any other well-known technique. Preferably, the mounting plate and base are molded of a nylon material.

Figure 17A:
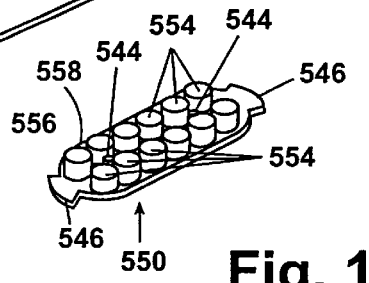
FIG. 17A is a top perspective view of a bristle brush platform according to the invention.
Figure 17:
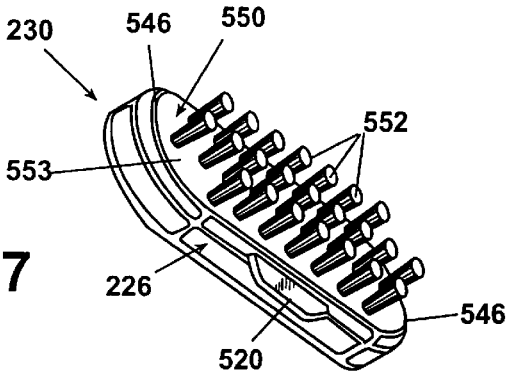
FIG. 17 is a bottom perspective view of a bristle brush assembly according to the invention for attachment to the recovery tank assembly.

Referring now to FIGS. 17 and 17A, the bristle brush assembly 230 comprises a mounting plate 550 attached to a base 226 with groupings 552 of relatively stiff fibers extending from a lower surface 553 of the mounting plate. The mounting plate 550 is similar in construction to the mounting plate 530, wherein like elements are represented by like numerals, with the exception of a plurality of hollow bosses 554 that project upwardly from the upper surface 556. An end cap 558 is preferably formed on each boss such that the hollow interior is only accessible from the lower surface 553. An end of each fiber grouping 552 is inserted into the hollow interior of one of the bosses 554 and adhered thereto, preferably through adhesives.

Figure 18:
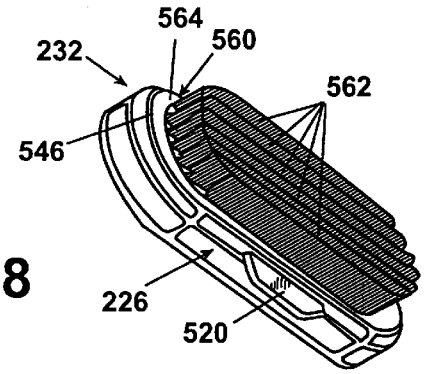
FIG. 18 is a bottom perspective view of an upholstery brush assembly according to the invention for attachment to the recovery tank assembly.

With reference now to FIG. 18, the upholstery brush assembly 232 comprises a mounting plate 560 attached to a base 226 with a plurality of teeth 562 extending from a lower surface 564 of the mounting plate 560. The teeth are preferably integrally molded with the mounting plate 560 and are relatively flexible due to their thin cross sectional dimensions. The outer free end of each tooth 562 is preferably pointed. The mounting plate 560 is otherwise identical in construction to the mounting plate 530, with like parts represented by like numerals.

Figure 19:
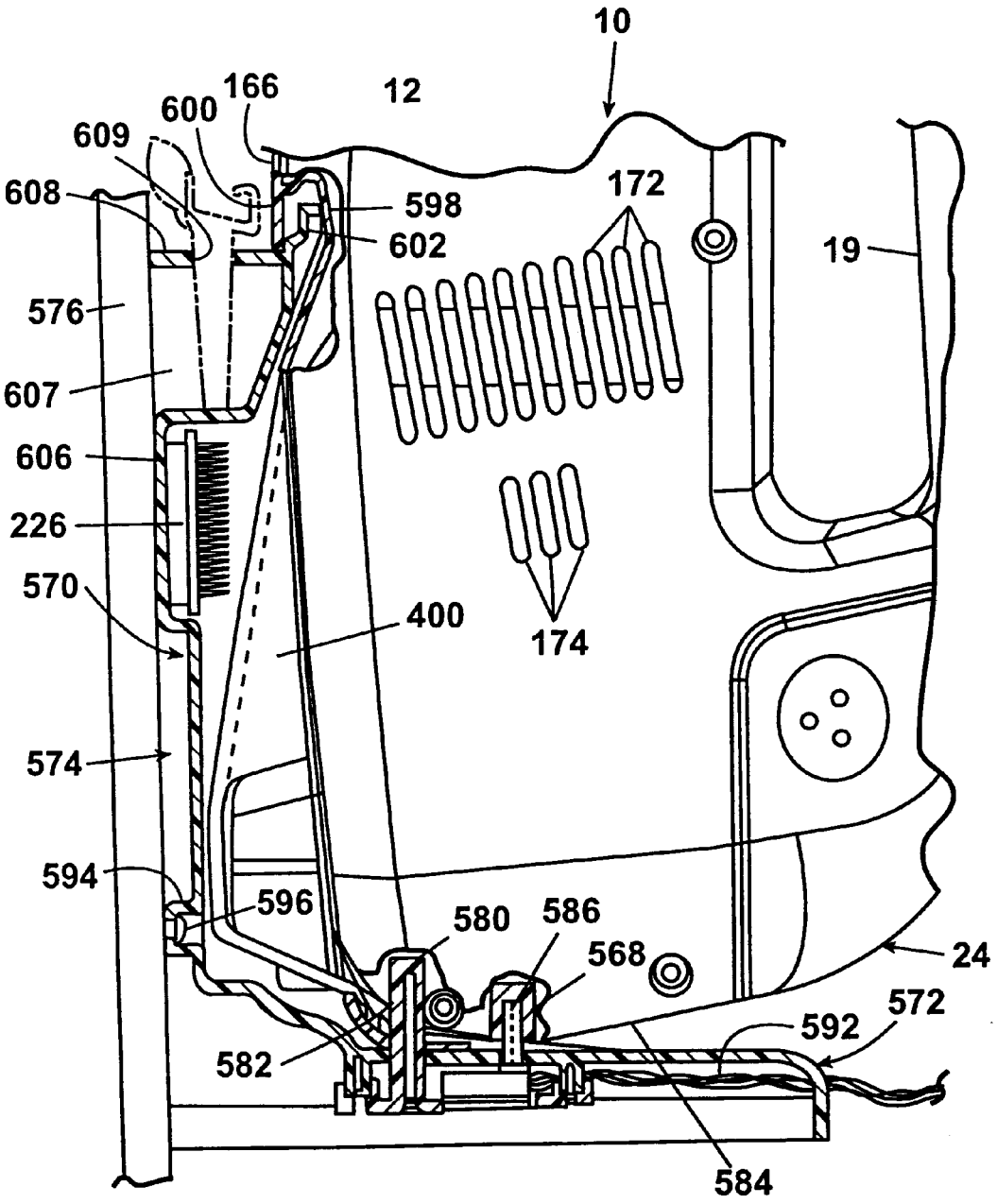
FIG. 19 is a cross sectional view of a cradle assembly according to a first embodiment of the invention for holding and recharging the handheld extraction cleaner.

As illustrated in FIG. 19, the handheld extraction cleaner 10 can be mounted on a storage and recharging cradle 570 when not in use. The cradle 570 includes a horizontal base portion 572 that can be supported on a horizontal surface and an integrally molded vertical holding portion 574 that can be attached to a vertical wall 576. The base portion 572 and holding portion 574 are preferably constructed of a continuous wall 578 that forms a shell-like structure. The base portion 572 has a guide pin 580 extending upwardly therefrom that fits within an opening 582 in a rear wall 584 of the housing 12 for aligning the extraction cleaner 10 on the cradle 570. A bipolar recharging pin 586 fits within an opening 588 of the rear wall 584 and plugs within an electrical receptacle 590 that is electrically connected to the battery pack 21.

An electrical cord 592 is electrically connected between the bipolar pin 586 and an AC/DC transformer (not shown) that can be plugged into an electrical outlet for supplying DC recharging current to the battery pack.

The vertical holding portion 574 includes a pair of vertically spaced bosses 594 (only one of which is shown) through which fasteners 596 can extend for mounting the cradle to the vertical wall 576. An upward projection 602 projects upwardly from the continuous wall 578 and is adapted to extend into a recess 598 in the lower wall 166 of the housing 12 and fit behind a depending wall 600 for supporting the handheld cleaner 10 on the cradle recharging cradle 570. A first recess 606 is provided for storage of brush 226 or other accessory. A second recess 607 is defined by a wall 608 that extends outwardly from the wall 602 and has a opening 609 for receiving a tool such as a squeegee.

Figure 21:
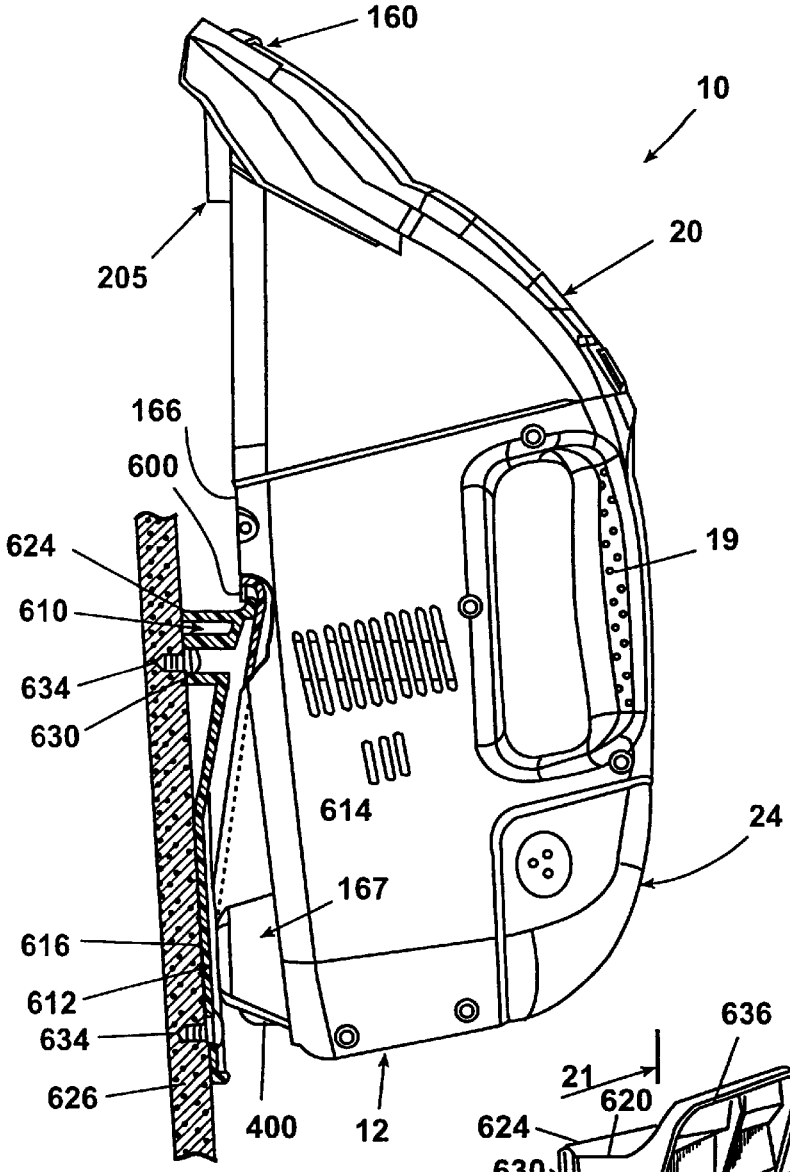
FIG. 21 is a cross-sectional view of the cradle assembly taken along line 21—21 of FIG. 20 and a side view of the handheld extraction cleaner mounted on the cradle assembly.
Figure 20:
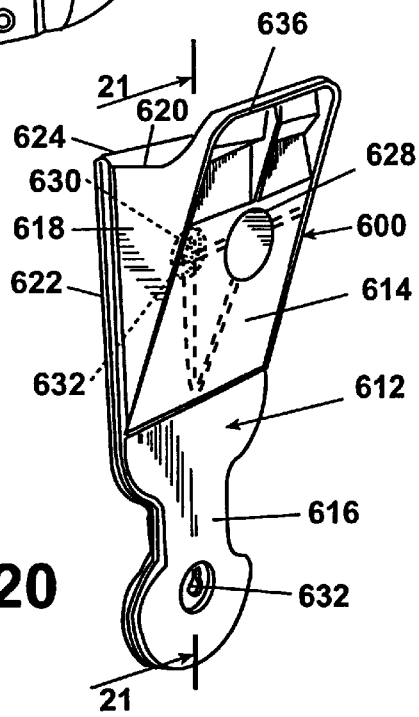
FIG. 20 is a top perspective view of a cradle assembly according to a second embodiment of the invention for holding the handheld extraction cleaner in a storage position.

With reference now to FIGS. 20 and 21, a cradle assembly 610 according to a second embodiment of the invention for holding the handheld extraction cleaner in a storage position is illustrated. The cradle assembly 610 comprises an inner wall 612 that is adapted to face the lower wall 166 of the extraction cleaner 10. The inner wall has an upper wall section 614 that extends at an obtuse angle with respect to a lower wall section 616. A pair of side walls 618 and a top wall 620 are integrally formed with the upper wall section 614. An outer edge 622 of the side walls 618 and an outer edge 624 of the upper wall section 614 contact a vertical wall 626 when the cradle assembly 610 is mounted thereto. A hollow boss 628 is integrally formed with the upper wall section 614 with an outer wall 630 thereof flush with the outer edges 622 and 624. Keyhole apertures 632 are formed in the outer wall 630 and the lower wall section 616. Fasteners 634 extend through the apertures 632 and are secured in the vertical wall 626 when the cradle assembly 610 is mounted thereto. As in the previous embodiment, a catch 636 projects upwardly from the top wall 620 and to the indentation 598 behind the depending wall 600. The handheld extraction cleaner thus hangs from the cradle assembly 610 in an upright vertical orientation with the housing foot portion 167 or the attached scoop 400 resting against the lower wall section 616. In this position, any fluid within the recovery tank assembly will not leak out through the nozzle opening 198.

Reasonable variation and modification are possible within the spirit of the foregoing specification and drawings without departing from the scope of the invention.

What is claimed is:

1. A handheld cleaner and storage base, comprising:

a handheld cleaner comprising:

a cleaner housing including a forward end, a rearward end, a top portion and a bottom portion extending between the forward and rearward ends, and sides extending between the top and bottom portions;

a handle for manually manipulating the extraction cleaner;

a storage base comprising:

a base portion and a holding portion disposed generally at a right angle to one another;

a first retainer between the holding portion of the base and the bottom portion of the cleaner housing for removably supporting the handheld cleaner on the storage base;

a second retainer between the base portion of the base and the rearward end of the cleaner housing for removably retaining the handheld cleaner on the storage base;

a recess formed in the holding portion of the base and adjacent to the bottom portion of the cleaner housing;

an accessory tool releasably stored in the recess.

2. A handheld cleaner and storage base according to claim 1 wherein the recess is formed between the sidewalls of the cleaner housing.

3. A handheld cleaner and storage base according to claim 1 wherein the recess opens distal from the bottom surface of the cleaner housing and includes a crevice tool mounted therein.

4. A handheld cleaner and storage base according to claim 1 wherein the recess opens toward the bottom surface of the cleaner housing and includes a brush mounted therein.

5. A handheld cleaner and storage base according to claim 1 and further comprising electrical contacts on the second retainer and electrical contacts on the rearward end of the cleaner housing in registry with one another when the handheld cleaner is mounted on the storage base, and wherein the handheld cleaner includes a battery and a charging circuit connected to the battery and the electrical contacts on the rearward end of the cleaner housing, whereby the battery is recharged when the cleaner is mounted on the storage base.

* * * * *